US005169166A

United States Patent [19]

Brooks

[11] Patent Number: 5,169,166

[45] Date of Patent: Dec. 8, 1992

[54] STEERING MECHANISM

[76] Inventor: Paul F. Brooks, 708 E. 8125 South, Sandy, Utah 84094

[21] Appl. No.: 754,008

[22] Filed: Sep. 3, 1991

[51] Int. Cl.[5] ..... A63C 17/01

[52] U.S. Cl. ..... 280/87.042; 280/11.27; 280/100; 280/112.2

[58] Field of Search ..... 280/11.19, 11.27, 11.28, 280/22.1, 87.041, 87.042, 86, 100, 111, 112.2, 688

[56] References Cited

U.S. PATENT DOCUMENTS

| | | | |
|---|---|---|---|
| 2,509,324 | 5/1950 | Van Horn | 280/11.28 |
| 3,331,612 | 7/1967 | Tietge | 280/87.042 X |
| 4,020,914 | 5/1977 | Trautwein | 280/112.2 X |
| 4,036,506 | 7/1977 | Scheib | 280/22.1 |
| 4,398,734 | 8/1983 | Barnhard | 280/11.28 |
| 4,740,004 | 4/1988 | McMullen | 280/112.2 X |
| 4,998,596 | 3/1991 | Miksitz | 280/112.2 X |

*Primary Examiner*—Charles A. Marmor
*Assistant Examiner*—Michael Mar
*Attorney Agent, or Firm*—Bryan A. Geurts

[57] ABSTRACT

A novel steering mechanism is provided which has both wheel tilting and steering capabilities. The steering mechanism comprises generally a platform, a plunger which is fixedly attached at one end to the bottom face of the platform, top and bottom axles of equal length disposed in parallel aligned space relationship to each other, a pair of wheels, and a steering rod.

The plunger hingedly intersects each axle. The top axle includes a forwardly extending steering rod holder and the bottom axle includes a rearwardly extending steering rod holder, the steering rod holders being in axial alignment with each other. One end of both the top and bottom axles are hingedly connected to one wheel while the other end of both axles are hingedly connected to the second wheel. A steering rod intersects both steering rod holders and the plunger in axially sliding relationship, such that when a downward vertical force is applied offset from the center of mass of the platform, the platform and plunger change position to a) bring the top and bottom axles out of alignment to cause the wheels to tilt, and b) bring the forwardly and rearwardly extending steering rod holders out of alignment to cause the platform to turn relative to the axles and wheels.

8 Claims, 4 Drawing Sheets

STEERING MECHANISM

BACKGROUND

1. Field

The present invention relates generally to steering mechanisms which respond to weight changes made by the operator and more specifically to a steering truck for use with skateboards, roller skates, scooters, and other similar skate-type devices wherein the wheels are not only turned but also tilted responsive to an operator's weight changes.

2. Prior Art

Steering trucks and similar steering mechanisms which are weight responsive are well known in the art. Generally, such mechanisms are attached to the bottom face of a platform or similar planar member upon which a weight rests or stands. Responsive to a change in the center of mass of the weight from one longitudinal side to the other, the platform tilts slightly to cause the mechanism to adjust the direction in which attached wheels are pointing.

While necessarily small in diameter, the wheels attached to such mechanisms have a relatively substantial width, such width often exceeding that of the diameter. Typical of this type of steering mechanism are U.S. Pat. No. 2,509,324, issued to Van Horn in 1986 and U.S. Pat. No. 4,398,734, issued to Barnard in 1983. Both the Barnard and Van Horn patents disclose a plunger which is rigidly affixed at one end to the bottom face of a platform, the plunger extending downwardly. An axle having wheels rotatably attached at both ends is affixed to the other end of the plunger, the axle including a leg which extends forwardly. The leg is attached to a leg holder which allows universal movement of the leg.

In this manner, when the center of mass of a weight atop the platform is shifted to one side of the platform or another, the platform and plunger correspondingly shift or tilt slightly, the plunger thereby causing the axle and wheels to turn.

While adequate for a number of applications, the type of steering truck just described includes a number of disadvantages. For example, this configuration requires that the wheels be fairly close together. This can become a problem when the steering mechanism is called upon to make sharp turns since the platform may tilt far enough over to make contact with the wheels. Thus, this configuration not only limits the turning radius of this type of steering mechanism, but the platform contacting the wheels can cause a dangerous situation as well.

For example, many skateboard riders, when riding their skateboard, have parts of their feet which hang over the edge of the platform. When making a sharp turn, it is not only conceivable, but probable, that this portion of the rider's foot which is hanging over the edge of the platform will come in contact with a wheel, or wheels, thereby throwing the rider off balance and probably causing an accident. Also, if the platform can come in contact with the wheels during a turn, undue wear and tear is caused on both the wheels and the platform.

Another problem caused by the configuration mentioned above is the size of the wheels. While providing a greater contact area with the ground, such wheels cannot tilt into a turn to assist in gripping the ground surface. Indeed, even assuming that such steering mechanisms provided for tilt in the wheels, which they do not, the extra wide wheels commonly used on skateboards could not be tilted during a turning manoeuver without virtually eliminating the ground contact sought to the maintained by use of the wide wheels. Thus, without the ability to tilt, horizontal forces experienced during the course of a turn, caused by the tendency of an object to travel in a straight path, must be completely absorbed by frictional forces between the wheels and the ground.

Therefore, there exists in the prior art a legitimate need for a steering mechanism which not only provides steering capabilities, but also provides tilting capabilities as well to allow increased turning capacity.

BRIEF SUMMARY AND OBJECTS OF THE INVENTION

In view of the above described state of the art, the present invention seeks to realize, among other things, the following objects and advantages.

A principal object of the present invention is to provide a novel steering truck mechanism which combines steering capabilities with tilting capabilities.

Another major object of the present invention is to provide a steering mechanism which is controlled by the transfer of weight about various points on a platform, said platform tilting slightly in response to the transfer of weight.

It is also an important object of the present invention to provide a steering mechanism controlled by weight transfer, as mentioned above, wherein the platform cannot come in contact with the wheels.

Still another principal objective of this invention is to provide a steering mechanism which includes wheels which have increased rotating capacity relative to the ground due to decreased friction.

Yet another major objective of the invention is to provide a high performance steering mechanism for use with skateboards which allows safer travel at higher speeds due to a wider wheel base and an increased turning capability due to tilting wheels.

It is a further object of the present invention to provide a steering mechanism which is efficient, durable, easily assembled, light weight, easily manufactured, and safe.

These and other objects and advantages of the invention will become more fully apparent from the description and claims which follow, or may be learned by the practice of the invention.

Accordingly, the steering mechanism of the present invention comprises generally a platform, a plunger which includes a proximate end which is fixedly attached to the broad face of the platform and a distal end which extends downwardly from the platform, top and bottom axles of equal length disposed in parallel line spaced relationship to each other, a pair of wheels disposed at the ends of the axles, and a steering rod.

The platform includes first and second longitudinal sides upon which a downward vertical force may be exerted, the downward vertical force causing the platform to change position from a substantially horizontal position to a tilted position. The plunger intersects each axle in hinged fashion, the top axle including a forwardly extended steering rod holder and the bottom axle including a rearwardly extending steering rod holder. The steering rod holders are in axial alignment with each other.

The steering rod intersects both rod holders and the plunger in an axially sliding relationship, such that movement of the steering rod is restricted to the axis formed by the alignment of the steering rod holders and the plunger. Upon application of the downward vertical force on either the first or second longitudinal side of the platform, the platform and plunger change position to a) bring the top and bottom axles out of alignment to cause the wheels to tilt, and b) bring the forwardly and rearwardly extending steering rod holders out of alignment to cause the platform to turn relative to the axles and wheels substantially about the axis formed by the downwardly extending plunger.

Advantageously, cushions are provided between the ends of the steering rod and the steering rod holders so as to return the top and bottom axles and the steering rod holders back into alignment upon release of the downward vertical force on one of the longitudinal sides of the platform. The hinged intersection of the plunger with each axle is facilitated by a ball and socket-type joint. At present preference, pivot pins in the hub of each wheel provides the hinged connection of the axles to the wheels.

BRIEF DESCRIPTION OF THE DRAWINGS

In order that the manner in which the above recited and other advantages and objects of the invention are obtained can be appreciated, a more specific description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
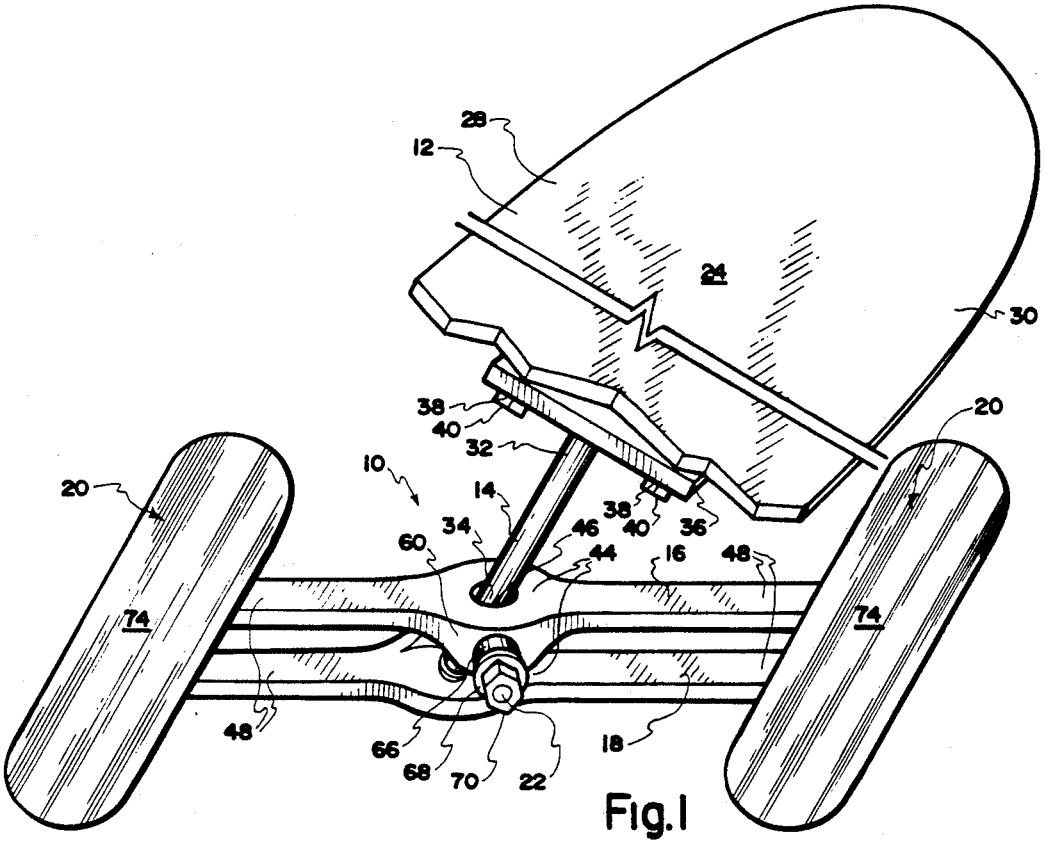
FIG. 1 is a partial front perspective view of the preferred embodiment of the present invention illustrating both steering and tilting capabilities.
Figure 2:
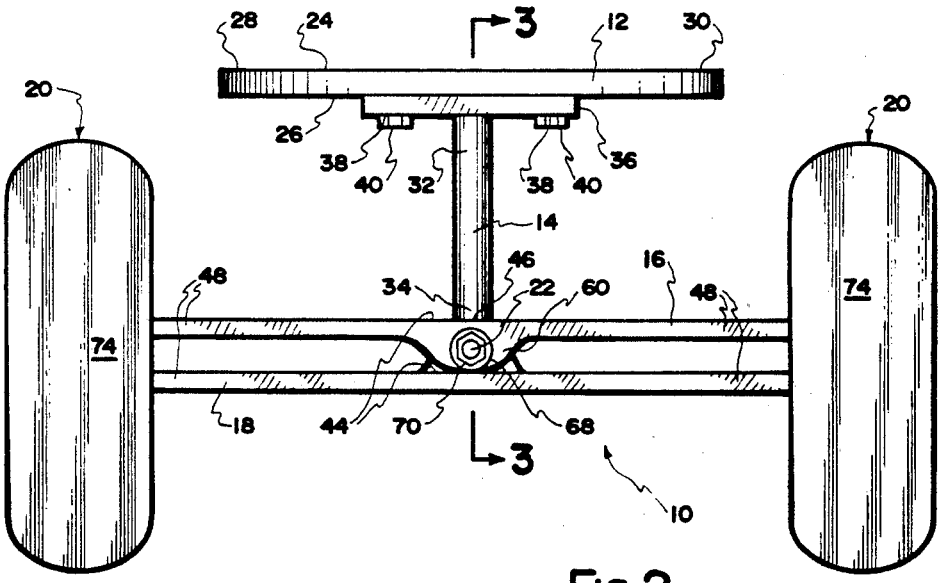
FIG. 2 is a front elevational view of the embodiment of FIG. 1.

Reference is now made to the drawings wherein like numerals are used to designate like components throughout. The presently preferred steering mechanism, generally designated 10, which has both wheel tilting and steering capabilities, comprises generally a platform 12, a plunger 14, identical top and bottom axles 16 and 18 respectively, a pair of wheels 20 and a steering rod 22. Each of these components will be described in greater detail hereafter.

The platform 12 is preferably a rigid planar member which may take a variety of different shapes. One preferred shape thereof is substantially rectangular such as may be used in conjunction with a skateboard. One skilled in the art will recognize that the shape of the platform 12 is best determined by the desired use of the steering mechanism 10.

Advantageously, the platform 12 is constructed of a substantially rigid material such as wood or plastic. Other materials, such as wood composites, steel, aluminum, and the like is also contemplated and falls within the purview of this invention.

The platform 12 includes top and bottom broad faces 24 and 2 respectively. When used in conjunction with a skateboard, the top broad face 24 of the platform 12 accommodates the operator, who stands thereon during operation. When used for other applications, any weight to be carried by the steering mechanism 10 is normally carried on the top broadface 24 of the platform 12.

The platform 12 further has first and second longitudinal sides 28 and 30 respectively upon which a downward vertical force may applied. As will be more fully explained hereafter, the steering mechanism 10 is actuated by a force, usually the weight of the operator, which is focused on either the first longitudinal side 28 or the second longitudinal side 30 of the platform 12.

The plunger 14 is generally rod shaped and has a proximate end 32 and a distal end 34. The proximate end 32 of the plunger 14 is fixedly attached to the bottom broadface 24 of the platform 12. Advantageously, this is accomplished by inclusion of an integrated plate 36 which is disposed normally to the longitudinal axis of the plunger 14. At present preference, the integrated plate 36 includes a plurality of apertures 38 at spaced intervals. Screws or bolts 40 may pass through the apertures 38 to attach the plunger 14 to the bottom broadface 26 of the platform I2. Alternative methods of attaching the plunger 14 to the platform 12 in fixed fashion, which are standard in the industry, are contemplated and thus should be considered within the scope of this invention.

The distal end 34 of the plunger 14 extends downwardly from the platform. Preferably, the plunger 14 is disposed vertically when the steering mechanism 10 is at rest, although variance from the vertical is crucial to the steering and tilting capabilities of the steering mechanism 10.

The distal end 34 of the plunger 14 is advantageously threaded for reasons described hereafter. Also, the distal end 34 includes a slot 42 through which the steering rod 22 passes, as described at a later juncture.

The top and bottom axles 16 and 18 respectively are identical, although oppositely disposed, and therefore will be described together. The axles 16 and 18 are, of course, of equal length and, when the steering mechanism 10 is at rest, are disposed in parallel aligned spaced relationship to each other.

Each of the axles 16 and 18, best illustrated in FIGS. 3 through 6, comprises a central portion 44 which includes an aperture 46, and two narrower arm or shaft portions 48 extending in opposing directions from the central portion 44. Thus, each axle 16 and 18 is generally elongate in shape.

At the free end of each arm portion 48 is a connector pin 50 which is used to connect the axles 16 and 18 to the wheels 20. Advantageously, the axles 16 and 18 are constructed of a structural metal such as steel, although one skilled in the art will recognize that other materials may be substituted therefor. As mentioned, the central portion 44 of each axle 16 and 18 includes an aperture 46 through which the plunger 14 extends during use.

Figure 4:
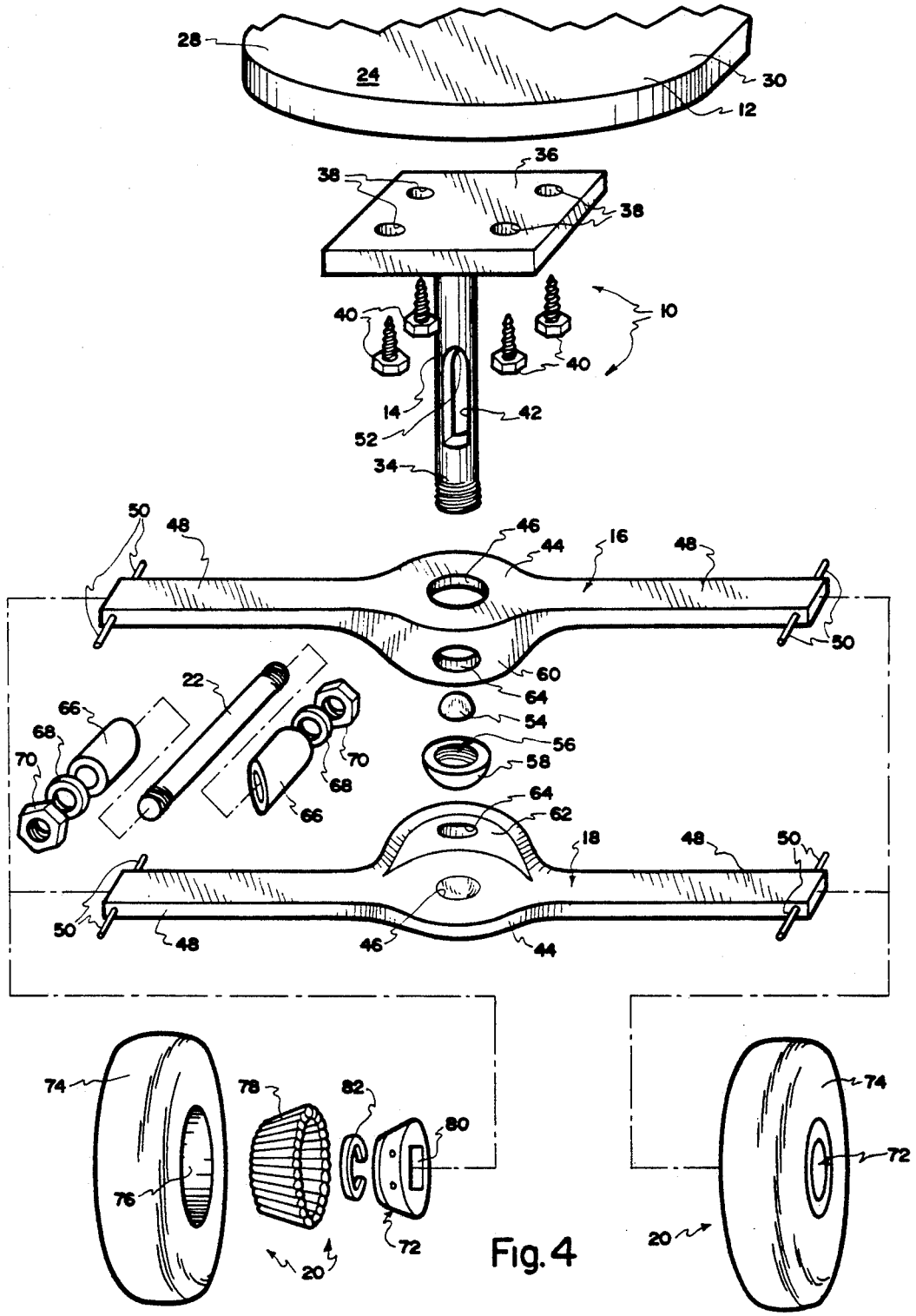
FIG. 4 is a partial exploded perspective view of the embodiment of FIG. 1.

Referring now particularly to FIG. 4, the plunger 14 also extends through an aperture 52 contained in an upper hemisphere 54, the upper hemisphere 54 being seated in the aperture 52 of the top axle 16 so as to resemble a ball and socket joint. Similarly, the distal end 34 of the plunger 14 extends into an aperture 56 in a lower hemisphere 58 which is seated in the aperture 46 in the bottom axle 18.

Importantly, the aperture 56 in the lower hemisphere 58 is threaded so as to receive the threads at the distal end 34 of the plunger 14. See FIG. 5. When assembled, the upper hemisphere 54 is seated not only in the aperture 52 but also in the slot 42 as well.

Figure 3:
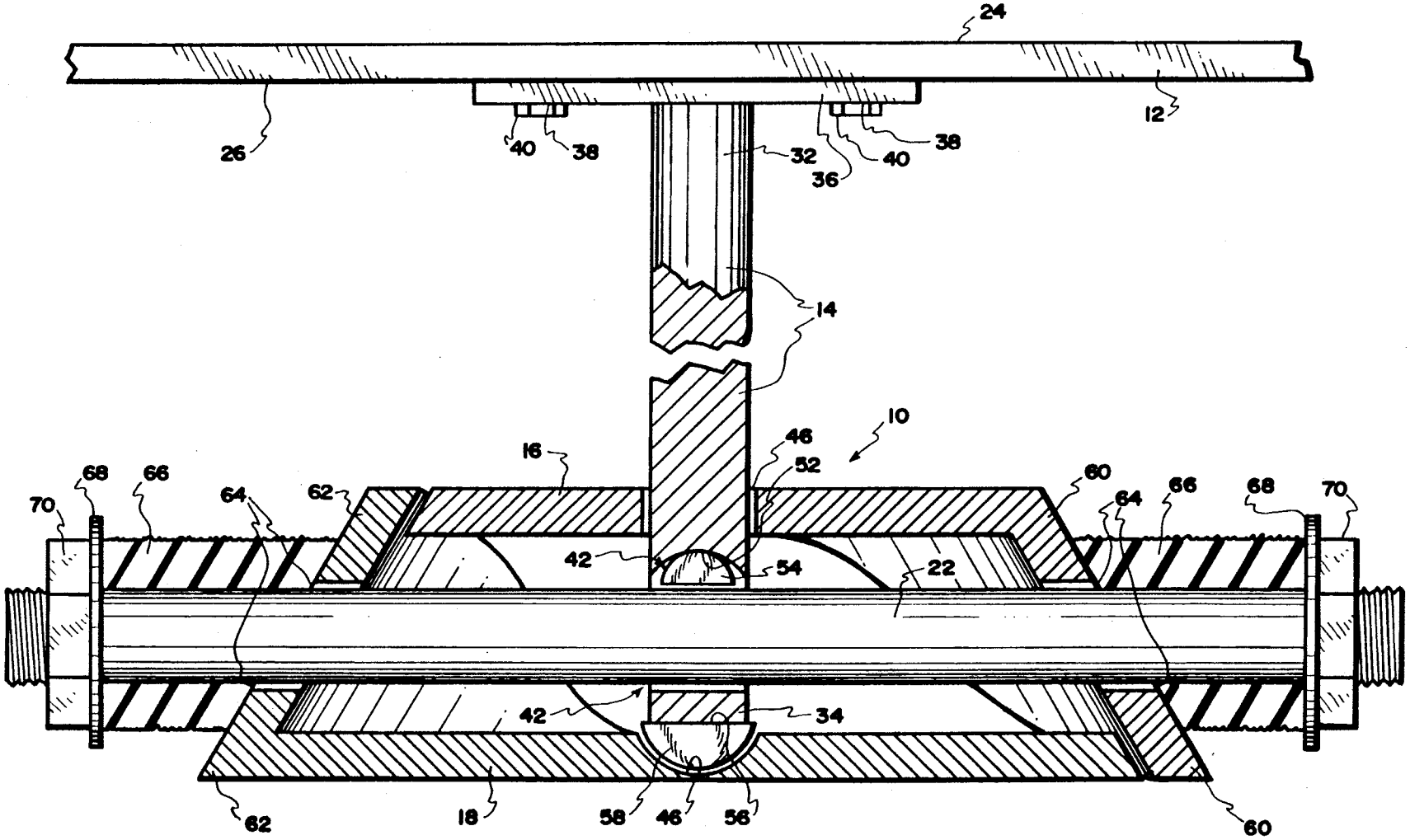
FIG. 3 is a partial side elevational view of the embodiment of FIG. 1, taken along the lines 3—3 of FIG. 2 and shown enlarged.

As best shown in FIGS. 3 and 4, the top axle 16 includes a forwardly extending steering rod holder 60 and bottom axle 18 includes a rearwardly extending steering rod holder 62. Preferably, each steering rod holder 60 and 62 comprises a semicircular plate which is integrally connected to the central portion 44 of the top and bottom axles 16 and 18 respectively. In the approximate center of the semicircular plate, an aperture 64 is drilled or otherwise formed. Importantly, the steering rod holders 60 and 62 are in axial alignment with each other.

Also, as best illustrated in FIG. 3, the forwardly extending steering rod holder 60 extends downwardly to form an angle of approximately b 120 degrees with top axle 16, while the rearwardly extending steering rod holder 62 extends upwardly to form an angle of approximately 60 degrees with the bottom axle 18.

The steering rod 22 passes first through the forwardly extending steering rod holder 60, through the slot 42 in the plunger 14, and finally through the rearwardly extending steering rod holder 62. Advantageously, the steering rod 22 intersects both steering rod holders 60 and 62 and the plunger 14 only in an axially sliding relationship such that little or no play is allowed.

Preferably, rubberized cushions 66 are wrapped about the steering rod 22 between one end thereof and the forwardly extending steering rod holder 60 and similarly between the other end and the rearwardly extending steering rod holder 62. Both ends of the steering rod 22 are threaded and each includes a washer 68 which is held in position by a threaded nut 70 to facilitate securing of the rubberized cushions 66 about the steering rod 22.

One skilled in the art will recognize that the rubberized cushions 66 comprise first and second flexing means for maintaining the steering rod holders 60 and 62 in axial alignment with each other. Thus, the cushions 66 bias the plunger 14 in a substantially vertical position and maintain the axles 16 and 18 in a parallel aligned spaced relationship when no outside force is applied to either the longitudinal sides 28 or 30 of the platform 12.

Also, it is important to recognize that the angled forwardly and rearwardly extending steering rod holders 60 and 62 respectively force the steering rod 22 to bow upwardly when an outside vertical force is applied to the platform 12. Significantly, this action assures that the upper hemisphere 54, which rests atop the steering rod 22, remains seated in the aperture 52 in the top axle 16 during tilting and steering motions.

The wheels 20 each comprise a hub 72, a tire 74, a race 76, and a set of roller bearings 78. Each of the axles 16 and 18 is hingedly connected to the hub 72, the end of each axle 16 and 18 being inserted through a slot 80 and being held therein by the connector pin 50.

Each tire 74 is preferably constructed of rubber or a similar friction gripping material and is securely mounted about the circumference of the race 76, the race 76 being frictionally attached to the interior surface of the tire 74. The set of roller bearings 78 is disposed between the race 76 and the hub 72 such that the hub 72 remains in a stationary position while the race 76 and the tire 74 rotate when the steering mechanism 10 is in motion. The hub 72, the tire 74, the race 76, and the set of roller bearings 78 may be held together by a standard retaining ring 82 which is well known in the art.

When a force is applied to either of the longitudinal sides 28 or 30 of the platform 12, the platform 12 tilts downwardly in the direction of the applied force. The plunger 14, being rigidly affixed to the platform 12, moves correspondingly. Responsive to this movement, the top axle 16 is pulled in the direction in which the platform 12 is tilting. The bottom axle 18 meanwhile is pushed in the opposite direction.

Figure 5:
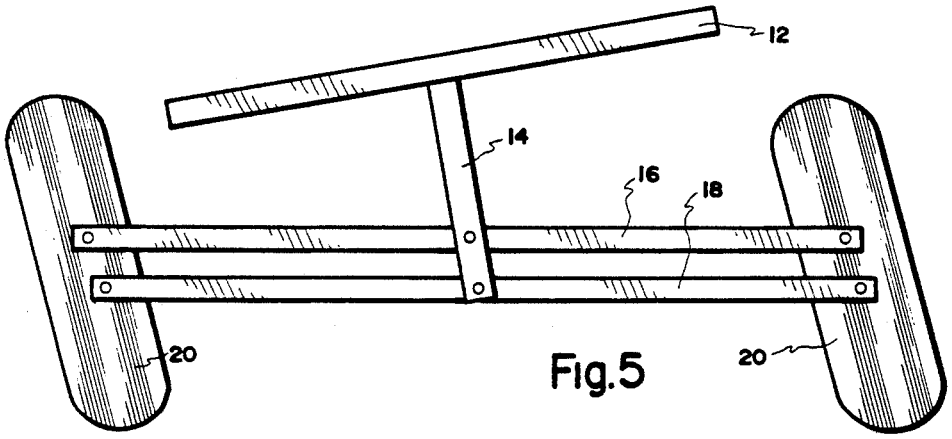
FIG. 5 is a front partial elevational view of the invention of FIG. 1 illustrating simplified tilting of the wheels.

Because both axles 16 and 18 are able to pivot about the connector pins 50 in the hub 72 of the wheels 20, the wheels 20 are forced to tilt in the direction of the applied force. As best shown in FIG. 5, the plunger 14 is secured to each axle 16 and 18 by means of the hemispheres 54 and 58 which are seated in the apertures 52 and 56 respectively of top axle 16 and bottom axle 18.

The weight transferred to the plunger 14 by the operator or other weight source on the top broadface 24 of the platform 12 keeps the lower hemisphere 58 firmly seated in the aperture 56 of the bottom axle 18, while the sliding upper hemisphere 54 is kept firmly pressed to the aperture 52 in the top axle 16 and the top of the slot 42 in the plunger 14 by the steering rod 22 which in turn is held in position by the cushions 66.

As tilting occurs, the forwardly and rearwardly extending steering rod holders 60 and 62 respectively become offset, thereby increasing pressure in the cushions 66. When the force applied to the platform 12 is removed, the cushions 66, seeking to relieve pressure, return the axles 16 and 18, as well as the plunger 14 and platform 12 to their preset positions.

Figure 6:
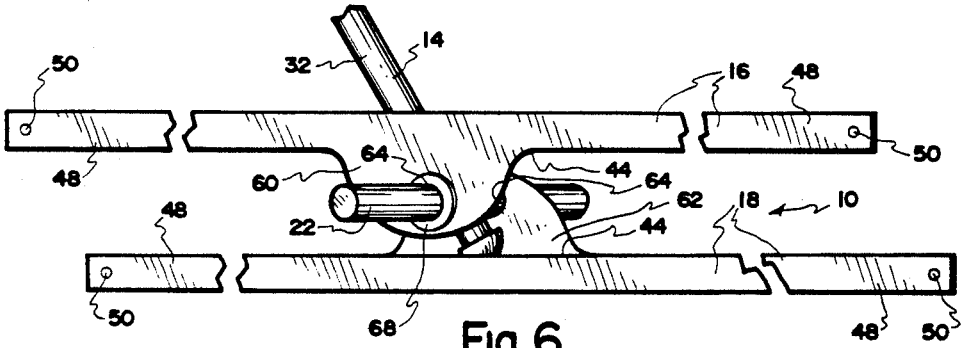
FIG. 6 is a partial front elevational view of the invention of FIG. 1 illustrating the combined steering and tilting principles.
Figure 7:
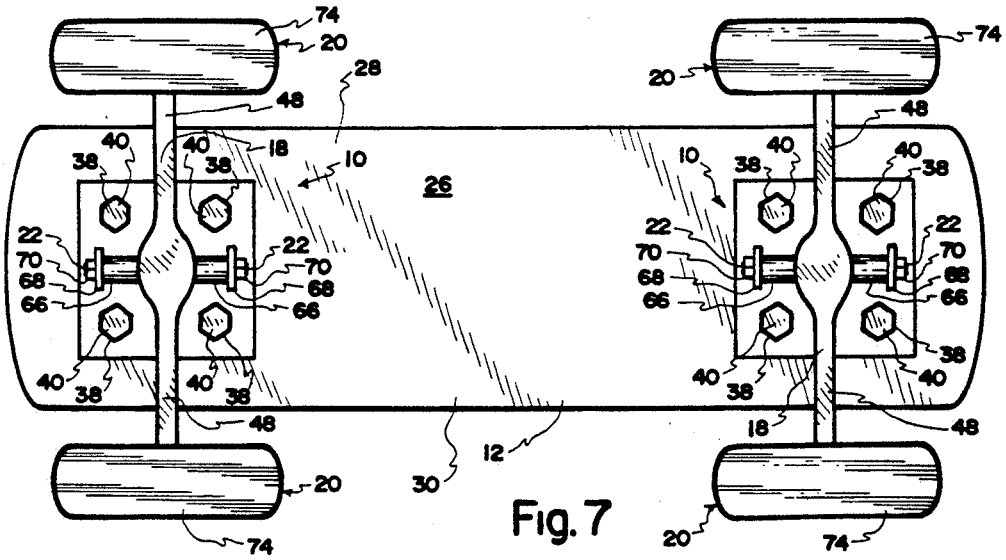
FIG. 7 is a bottom plan view of the invention of FIG. 1.

Conversely, when the plunger 14 moves responsive to an applied force, the plunger 14 forces the top and bottom axles 16 and 18 respectively to move in opposite directions. As seen in FIG. 6, the steering rod holders 60 and 62, which are usually in alignment, are thereby forced out of alignment. In this manner, the top axle 16 and the bottom axle 18 attempt to rotate the plunger 14.

However, the plunger 14 is immovable relative to the platform 12 and thus the top and bottom axles 16 and 18 respectively are forced to pivot in an opposite direction, thereby facilitating the steering action. As with the tilting motion, the cushions 66 will return all components to their preset positions when the offset force on the platform 12 is removed.

Therefore, one skilled in the art will recognize that when a downward vertical force is applied to either the first or second longitudinal side 28 or 30 respectively of the platform 12, the platform 12 and plunger 14 change position to a) bring the top and bottom axles 16 and 18 respectively out of alignment to cause the wheels 20 to tilt, and b) bring the forwardly and rearwardly extending steering rod holders 60 and 62 respectively out of alignment to cause the platform 12 to turn relative to the axles 16 and 18 and wheels 20.

One skilled in the art will also recognize that the ratio between steering and tilting can be adjusted by varying the distance between the respective steering rod holders 60 and 62 and the plunger 14.

Although the preferred embodiment of the present invention has been illustrated and described, it is to be understood that the present disclosure is made by way of example and that various other embodiments are possible without departing from the subject matter coming within the scope of the following claims, which subject matter is regarded as the invention.

I claim:

1. A steering mechanism having both wheel tilting and steering capabilities, said steering mechanism comprising:

a platform including top and bottom broad faces and having first and second longitudinal sides upon which a downward vertical force may be exerted, a plunger having proximate and distal ends, the proximate end thereof being fixedly attached to the bottom broad face of the platform, and the distal end thereof extending downwardly from the platform, top and bottom axles of equal length disposed in parallel aligned spaced relationship to each other, the plunger hingedly intersecting each axle, and the top axle including a forwardly extending steering rod holder and the bottom axle including a rearwardly extending steering rod holder, the steering rod holders being in axial alignment with each other, a pair of wheels, one end of both the top and bottom axles being hingedly connected to the first wheel and the other end of both axles being hingedly connected to the second wheel, and a steering rod which intersects both steering rod holders and the plunger in axially sliding relationship, such that when a downward vertical force is applied to either the first or second longitudinal side of the platform, the platform and plunger change position to a) bring the top and bottom axles out of alignment to cause the wheels to tilt, and b) bring the forwardly and rearwardly extending steering rod holders out of alignment to cause the platform to turn relative to the axles and wheels.

2. A steering mechanism according to claim 1 wherein the steering rod includes first and second ends, and which further comprises first flexing means disposed between the first end of the steering rod and the forwardly extending steering rod holder, and second flexing means disposed between the second end of the steering rod and the rearwardly extending steering rod holder, said first and second flexing means for maintaining the steering rod holders in axial alignment with each other.

3. A steering mechanism according to claim 2 wherein the first and second flexing means are rubberized cushions wrapped about the steering rod.

4. A steering mechanism according to claim 3 wherein the first and second ends of the steering rod are threaded and each includes a washer which is held in position by a threaded nut to facilitate securing of the rubberized cushions about the steering rod.

5. A steering mechanism according to claim 1 wherein each wheel comprises:

a hub to which the axles are hingedly connected, tire including an interior surface, a race fixedly attached to the interior surface of the tire, and a set of roller bearings disposed between the race and the hub such that the hub remains in a stationary position while the race and tire rotate when the steering mechanism is in motion.

6. A steering mechanism according to claim 1 wherein the hinged intersection between the plunger and each axle is a ball and socket type joint.

7. A steering mechanism according to claim 1 wherein the hinged connection between the ends of the axles and the wheels is a pin connection.

8. A skateboard assembly for recreational and competitive use comprising:

a platform having top and bottom broad faces and including first and second longitudinal sides upon which a downward vertical force may be exerted, a pair of identical, but oppositely disposed, steering mechanisms, each steering mechanism being fixedly attached to the bottom broad face of the platform and each steering mechanism comprising a plunger extending downwardly from the platform, top and bottom axles of equal length disposed in parallel aligned spaced relationship to each other, the plunger hingedly intersecting each axle, and the top axle including a forwardly extending steering rod holder and the bottom axle including a rearwardly extending steering rod holder, the steering rod holders being in axial alignment with each other, a pair of wheels, one end of both the top and bottom axles being hingedly connected to the first wheel and the other end of both axles being hingedly connected to the second wheel, and a steering rod which intersects both steering rod holders and the plunger in axially sliding relationship.

* * * * *